US006908170B2

(12) United States Patent
Merz

(10) Patent No.: US 6,908,170 B2
(45) Date of Patent: Jun. 21, 2005

(54) DEVICES FOR DISSIPATING HEAT IN A FLUID EJECTOR HEAD AND METHODS FOR MAKING SUCH DEVICES

(75) Inventor: Eric A. Merz, Palmyra, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/600,507

(22) Filed: Jun. 23, 2003

(65) Prior Publication Data

US 2004/0257393 A1 Dec. 23, 2004

(51) Int. Cl.[7] ..... B41J 29/377
(52) U.S. Cl. ..... 347/18
(58) Field of Search ..... 347/17, 18, 223

(56) References Cited

U.S. PATENT DOCUMENTS 5,506,608 A * 4/1996 Marler et al. ..... 347/18
6,076,912 A * 6/2000 Murthy ..... 347/18
6,343,848 B2 2/2002 Berg et al.
6,844,054 B2 * 1/2005 Whatley ..... 428/295.4
2003/0064508 A1 * 4/2003 Kwasnoski et al. ..... 435/288.4

FOREIGN PATENT DOCUMENTS

JP 02187350 A * 7/1990 ..... B41J/2/045

* cited by examiner

*Primary Examiner*—Stephen D. Meier
*Assistant Examiner*—Blaise Mouttet
(74) *Attorney, Agent, or Firm*—Oliff & Berridge, PLC

(57) ABSTRACT

A fluid ejector assembly includes a container that stores a fluid to be ejected, a heat sink attached to the container, and a die module bonded to the heat sink. The heat sink is molded from a polymer that has at least one thermally conductive filler material mixed into the polymer. The heat sink is shaped to dissipate heat. The fluid ejector assembly is manufactured by mixing the at least one thermally conductive filler material with the polymer, molding the heat sink using the polymer and thermally-conductive filler material mixture, and attaching the heat sink to a die module and, optionally, to a fluid-containing container.

17 Claims, 5 Drawing Sheets

DEVICES FOR DISSIPATING HEAT IN A FLUID EJECTOR HEAD AND METHODS FOR MAKING SUCH DEVICES

BACKGROUND OF THE INVENTION

1. Field of Invention

This invention is directed to apparatus and methods for dissipating heat in fluid ejector heads.

2. Description of Related Art

A variety of devices and methods are conventionally used to dissipate heat in a thermal fluid ejector head. The thermal fluid ejector heads of fluid ejection devices, such as, for example ink jet printers, generate significant amounts of residual heat as the fluid is ejected by heating the fluid to the point of vaporization. This residual heat will change the performance and ultimately the ejection quality if the heat remains within the fluid ejector head. The ejector performance is usually seen by a change in the drop size, firing frequency, or other ejection metrics. Such ejection metrics are required to stay within a controllable range to have acceptable ejection quality. During lengthy operation or heavy coverage ejection, the temperature of the fluid ejector head can exceed an allowable temperature limit. Once the temperature limit has been exceeded, a slow down or cool down period is required to maintain the ejection quality.

Many fluid ejection devices, such as, for example, printers, copiers and the like, improve throughput by improving thermal performance. One technique to improve fluid ejector head performance is to divert excess heat into the fluid being ejected. Once the fluid being ejected has exceeded a predetermined temperature, the hot fluid is ejected from the fluid ejector head. During lengthy operation or during heavy area coverage ejection, this technique is also susceptible to temperatures in the fluid ejector head exceeding the maximum allowable temperature.

Another technique is to use a heat sink to store or conduct heat away from the fluid ejector head. Typically, these heat sinks are made from copper, aluminum or other materials having high thermal conductivity to remove heat from the fluid ejector head.

SUMMARY OF THE INVENTION

When such materials are used, however, the heat sink adds additional weight, size, cost and energy usage to the fluid ejector head, especially for fluid ejector heads that are translated past the receiving medium. Additionally, fluids, such as inks, typically use solvents and/or salts which are likely to corrode aluminum or copper.

The heat sinks are typically bonded to a substrate. The substrate materials are often made from a conductive metal, such as aluminum or copper, that conducts heat away from a die module of the fluid ejector head. However, some fluid ejection devices use a plastic substrate that has a relatively low thermal conductivity. When metal heat sinks are used, the bond between the substrate and the die is subjected to significant stress due to temperature changes. The stress is generated from the large mismatch between the coefficients of thermal expansions of the substrate and the die.

These stresses create delaminating problems, where the die separates from the substrate, or the layers of the die separate. Also, the stress presents additional fluid ejection quality and reliability issues.

This invention provides systems and methods for dissipating heat in a fluid ejector head.

This invention separately provides devices and methods for obtaining better thermal conductivity in polymer heat sinks.

In various exemplary embodiments of the devices and methods of this invention, a heat sink including a surface area molded from a polymer having thermally conductive filler materials is attached to structure to be cooled. In various exemplary embodiments, the surface area of a heat sink is shaped to dissipate heat.

In various exemplary embodiments of the systems and methods of this invention, a die module of a fluid ejector is bonded to a heat sink made of materials having similar coefficients of thermal expansion.

In various exemplary embodiments of the devices and methods of this invention, filler materials within a polymer heat sink are oriented in an oriented flow area so that the filler materials extend substantially parallel to the die module of the fluid ejector head.

These and other features and advantages of the this invention are described in, or apparent from, the following detailed descriptions of various exemplary embodiments of the systems and methods according to this invention.

BRIEF DESCRIPTION OF THE DRAWINGS

Various exemplary embodiments of the invention will be described in detail with reference to the following figures, wherein.

DETAILED DESCRIPTION OF EXEMPLARY EMBODIMENTS

Figure 1:
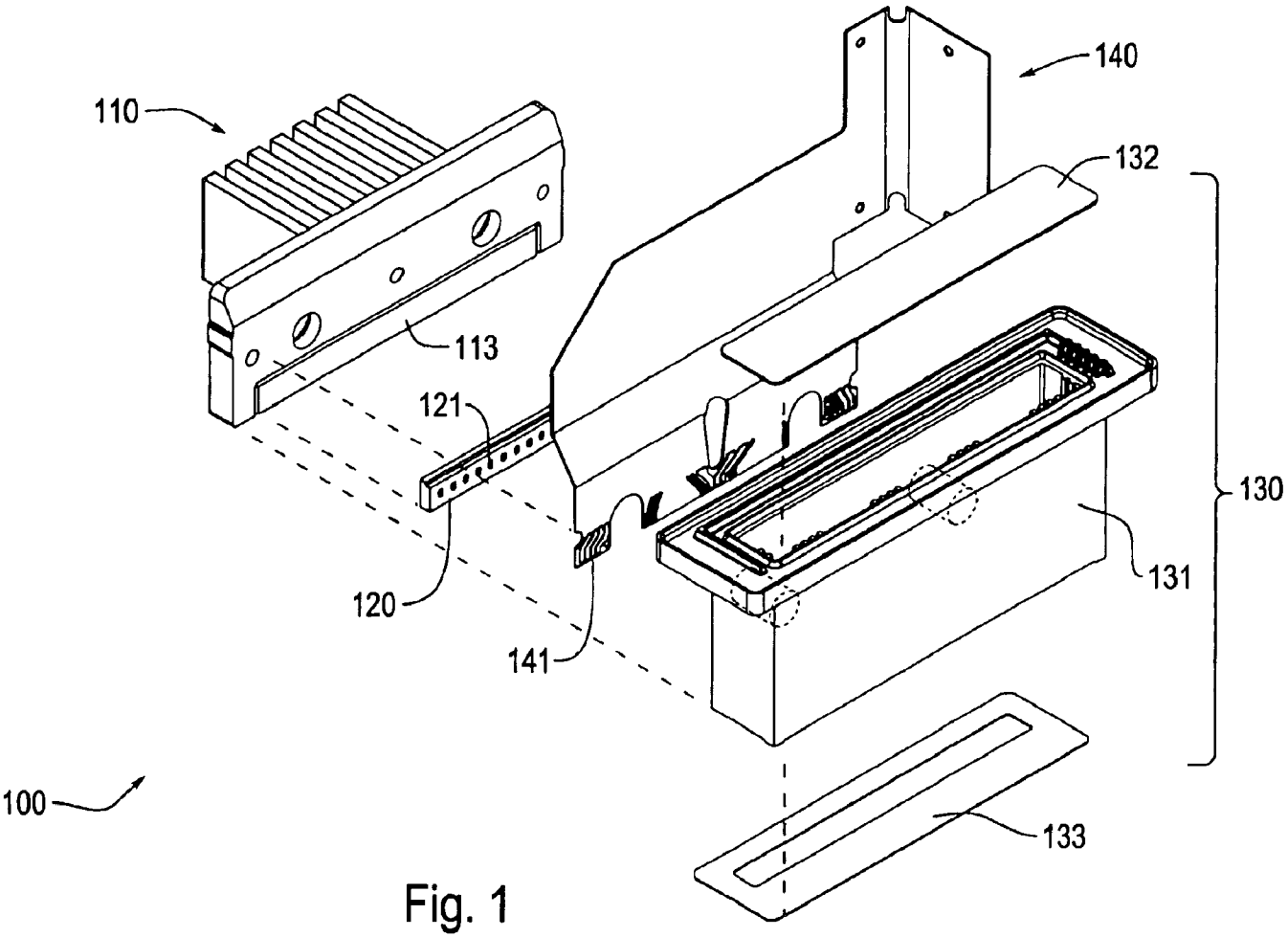
FIG. 1 is a block diagram illustrating a first exemplary embodiment of a fluid ejector head usable with various exemplary embodiments of the systems and methods according to this invention.

The following detailed description of various exemplary embodiments of the fluid ejection systems according to this invention may refer to and/or illustrate one specific type of fluid ejection system, an ink jet printer, for sake of clarity and familiarity. However, it should be appreciated that the principles of this invention, as outlined and/or discussed below, can be equally applied to any known or later developed fluid ejection systems, beyond the ink jet printer specifically discussed herein.

Various exemplary embodiments of the systems and methods according to this invention enable the dissipation of heat from fluid ejector heads, such as, for example, thermal ink jet printers, copiers and/or facsimile machines, by using a polymer mixed with one or more thermally conductive filler materials. In various exemplary embodiments, the device and techniques according to this invention provide polymer heat sinks having one or more filler materials with properties that allow the polymer heat sink to more readily dissipate heat, while the polymer heat sink, as a whole, has a similar coefficient of thermal expansion to the die of the thermal fluid ejector head.

In various exemplary embodiments, the heat sink according to this invention is manufactured using a highly conductive polymer. The highly conductive polymer has thermal conductivities in the range of above 10 W/m° C. to about 100 W/m° C. This thermal conductivity is typically about 50–500 times greater than that of standard plastics, which ranges from 0.1–0.3 W/m° C. The highly conductive polymer has a thermal conductivity which is close to the thermal conductivity of aluminum. The thermal conductivity of aluminum is about 100–150 W/m° C. These polymers may also be easily injection molded into shapes that tend to maximize the surface area, and thus the heat dissipation rate, of the heat sink.

In general, these highly-thermally-conductive polymer materials can be either electrically conductive or electrically non-conductive. In general, the electrically-conductive highly-thermally-conductive polymer materials are more thermally conductive than the electrically-non-conductive highly-thermally-conductive polymer materials. Because these highly-thermally-conductive polymer materials are being used in close proximity to miniature electrical circuits in the fluid ejector head, using electrically-conductive highly-thermally-conductive polymer materials may cause strange or improper behavior in the electrical circuits. Thus, an insulation layer between the fluid ejector head and the heat sink may be provided when electrically-conductive highly-thermally-conductive polymer materials are used.

The heat sink is used to carry heat away from a die of a thermal fluid ejection head, allowing the fluid ejector head to operate for extended periods of time. Operating a fluid ejector head for extended periods of time typically increases the temperatures in the die of the fluid ejector head. Dissipating the heat away from the die allows the fluid ejector head to operate at temperatures cool enough to enable high quality fluid ejection.

In various exemplary embodiments according to this invention, the highly conductive polymers used for the heat sink material includes base polymers mixed with a variety of filler materials. For example, one such polymer material is COOL POLY™ made by Cool Polymers Inc. Specifically, the COOL POLY E200™ polymer material is an injection-moldable, a liquid-crystal-polymer-based material having a thermal conductivity of 60 W/m° C. and a coefficient of thermal expansion (parallel to flow) of about 5 μm/m per degree C.

Recently, other companies, such as Polyone, LDP Engineering Plastics, RTP Company, GE and Dupont, have developed highly conductive polymers that may also be used with the heat sinks according to this invention.

Typical filler materials include graphite fibers and ceramic materials, such as boron nitride and aluminum nitride fibers. In various exemplary embodiments, blends of highly conductive polymers having high thermal conductivity use graphite fibers formed from a petroleum pitch base material. Typical base material for the polymers include liquid crystal polymer (LCP), polyphenylene sulfide and polysulfone.

In various exemplary embodiments, the heat sink is bonded to the die of the fluid ejector head. The die of the fluid ejector head is typically made from silicon, which has a coefficient of thermal expansion of about 4.67 μm/m° C.

Table 1 lists various properties for some commonly used substrate materials and for an exemplary highly conductive polymer, i.e, COOL POLY E200™ manufactured by Cool Polymers Inc.

TABLE 1

| Material | Coefficient of Thermal Expansion (μm/m° C.) | Elastic Modulus (Gpa) | Shear Force (Calculated[1]) (N) |
|---|---|---|---|
| Aluminum | 23 | 70 | 2.14 |
| Copper | 11.7 | 110 | 1.18 |
| Noryl | 72 | 2.4 | 0.32 |
| CoolPoly E200 (parallel to flow direction) | 5 | 60 | 0.033 |
| CoolPoly E200 (perpendicular to flow) | 15 | 60 | 1.06 |

[1]The calculated shear force in Table 1 assumes a 3 mm × 1 mm × 25 mm silicon die bonded to 5 mm thick substrate for a 30° C. temperature change.

The calculated shear force F between the die and heat sink substitute is determined as:

$$F=[(\alpha_s-\alpha_d)\Delta T]/[(1/E_sA_s)+(1/E_dA_d)],$$

where:

$\alpha_s$ is the thermal expansion coefficient of the substrate;

$\alpha_d$ is the thermal expansion coefficient of the die, which is 4.67 um/m° C. for die mode of silicon;

$E_s$ is the elastic modulus of the substrate;

$E_d$ is the elastic modulus of the die, which is 70 GPa for dies formed of silicon;

$A_s$ is the cross-sectional area of the substrate; and $A_d$ is the cross-sectional area of the die.

As shown in Table 1, when the one or more thermally conductive filler materials are oriented parallel to the flow direction in a mold, the coefficient of thermal expansion of the polymer/filler material mixture is 5 μm/m° C. Often, the filler materials are fibers. When fibers are used, the long axis of the fibers becomes aligned with the flow direction, the polymer/filler material mixture has anisotropic coefficient of thermal expansion properties. When the one or more thermally conductive filler materials are oriented in the polymer perpendicular to the flow, the coefficient of thermal expansion of the polymer/filler material mixture is 15 μm/m° C. across the fibers, but is less along the fibers. By orienting the thermally conductive materials parallel to the flow direction, the coefficient of thermal expansion more effectively matches the coefficient of thermal expansion of the material used to make the die module. Thus, a significant reduction in the shear forces is obtained and more effective bonding is achieved.

FIG. 1 illustrates a first exemplary embodiment of a thermal fluid ejector assembly 100 including a device that dissipates heat from the thermal fluid ejector head. As shown in FIG. 1, the thermal fluid ejector assembly 100 includes a heat sink 110, a fluid ejector element 120, a fluid supply manifold 130 and a printed circuit board 140.

It should be appreciated that the fluid supply manifold 130 is optional. Thus, the fluid supply manifold 130 or a device with a similar function and/or operation may or may not be used.

The fluid ejector element 120 is attached to the heat sink 110 by epoxy resin, thermal welding or any other appropriate attaching method. The fluid ejector element 120 includes a plurality of apertures 121 through which fluid, such as ink, is injected. The fluid ejector element 120 is connected to a printed circuit board 140.

In various exemplary embodiments, the printed circuit board 140 includes electrically connected traces on a substrate with contact pads 141 at one end, which are connected to the fluid ejector element 120. The other end of the printed circuit board 140 is shaped to be connected to an electrical connector. The printed circuit board 140 may be shaped in various sizes and shapes to allow a suitable electrical connection. The printed circuit board 140 also includes slots for sandwiching the printed circuit board 140 between the heat sink 110 and the fluid supply manifold 130.

In various exemplary embodiments, the fluid supply manifold 130 includes a fluid chamber 131, a filter 132 and a face tape 133. The filter 132 is attached to the top of the fluid chamber 131 and the face tape 133 is attached to the lower portion of the fluid chamber 131.

In various exemplary embodiments, the fluid ejector manifold 130 includes a fluid chamber 131 that may or may not be periodically refilled. The fluid ejector element 120 is attached under the fluid chamber 131. The fluid chamber also includes mounting posts for attaching the fluid chamber 131 to the heat sink 110. The printed circuit board 140 is electrically connected to the fluid ejector element 120 and sandwiched between the fluid chamber 131 and the heat sink 110. In various other exemplary embodiments, rather than the fluid ejector manifold 130 containing the chamber 131, the fluid chamber 131 is provided integrally with the heat sink 110 and this is formed using the same material as the heat sink 110. In this case, the fluid manifold 130 conducts the fluid from the fluid chamber 131 to the fluid ejector element 120.

Figure 2:
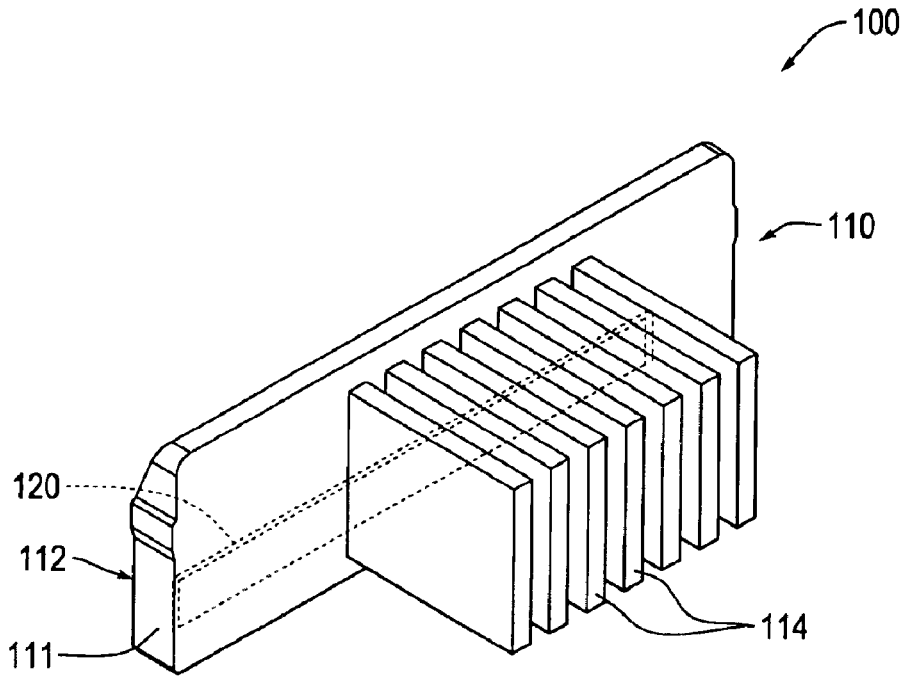
FIG. 2 is a block diagram of a first exemplary embodiment of a heat sink formed using the systems and methods according to this invention.

FIG. 2 illustrates a first exemplary embodiment of the heat sink 110 of the thermal fluid ejector head 100 of FIG. 1. In various exemplary embodiments, the heat sink 110 includes a base 111 from which a plurality of heat transfer surfaces extend outwardly. As shown in FIG. 2, in this first exemplary embodiment, the heat transfer surfaces are fins 114. As shown in FIG. 2, the heat sink 110 includes seven fins 114 extending from the base 111. Although FIG. 2 illustrates the fins 114 in a specific arrangement, it should be appreciated that any suitable effective number, size and/or orientation of the fins 114 may be used.

As shown in FIG. 2, the fluid ejector element 120 is attached to the side surface 112 using an adhesive 113 (shown in FIG. 1). However, it should be appreciated that other methods may be used to attach the fluid ejector element 120 to the side surface 112, such as, for example, welding, mechanical clamping, and the like. Additionally, it should be appreciated that the fluid ejector element 120 may be attached to other surfaces of the base 111.

Figure 3:
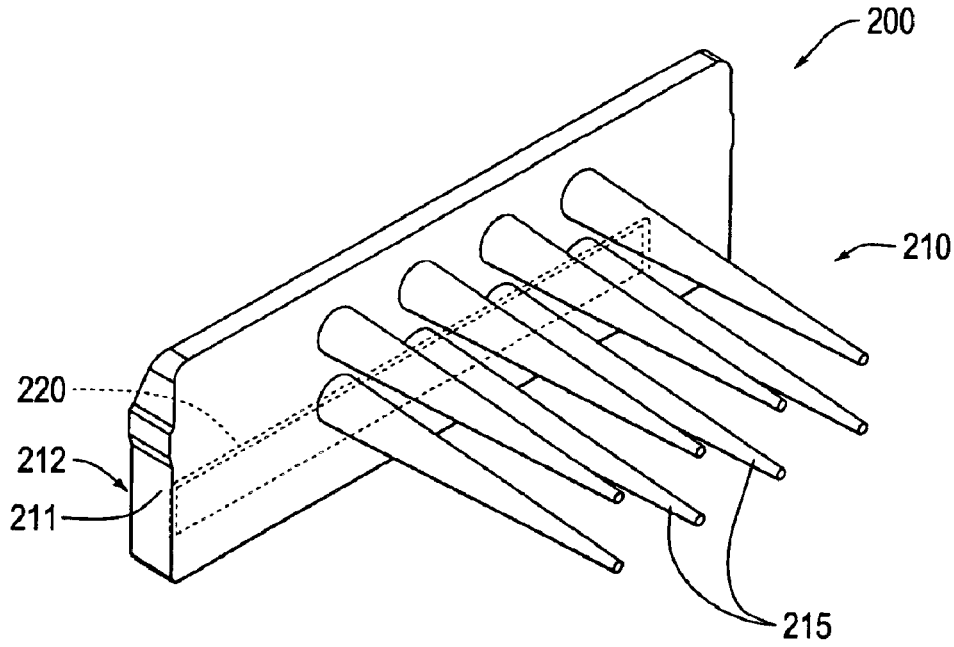
FIG. 3 is a block diagram illustrating a second exemplary embodiment of a heat sink formed using the systems and methods according to this invention.

FIG. 3 shows a second exemplary embodiment of a fluid ejector assembly 200 that dissipates heat from the thermal fluid ejector head. As shown in FIG. 3, the fluid ejector assembly 200 includes a fluid ejector element 220 and a heat sink 210. The heat sink 210 includes a number of extension pins 215 that extend outwardly from a base 211.

In various exemplary embodiments, the fluid ejector element 220 is attached to the side surface 212 using an adhesive, welding, mechanical connectors, or the like.

Figure 4:
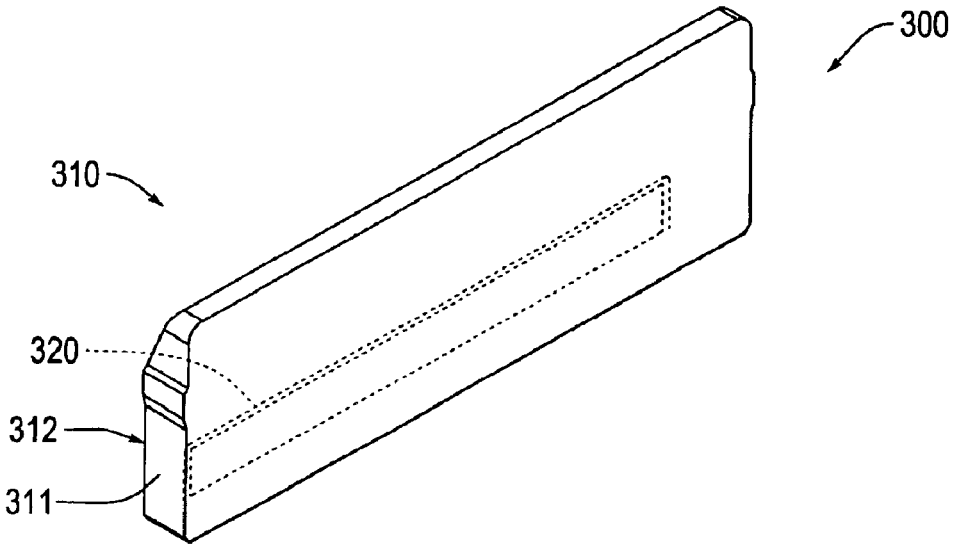
FIG. 4 is a block diagram illustrating a third exemplary embodiment of a heat sink formed using the systems and methods according to this invention.

FIG. 4 shows a third exemplary embodiment of a fluid ejector assembly 300 according to this invention. As shown in FIG. 4, the fluid ejector assembly 300 includes a heat sink 310 and fluid ejector element 320. The heat sink 310 includes a base 311. In various exemplary embodiments, the fluid ejector element 320 is attached to side surface 312 of the base 311. In this exemplary embodiment, the heat sink 310 does not include pins or fins. The material in the base 311 provides adequate heat dissipation in certain working environments.

Figure 5:
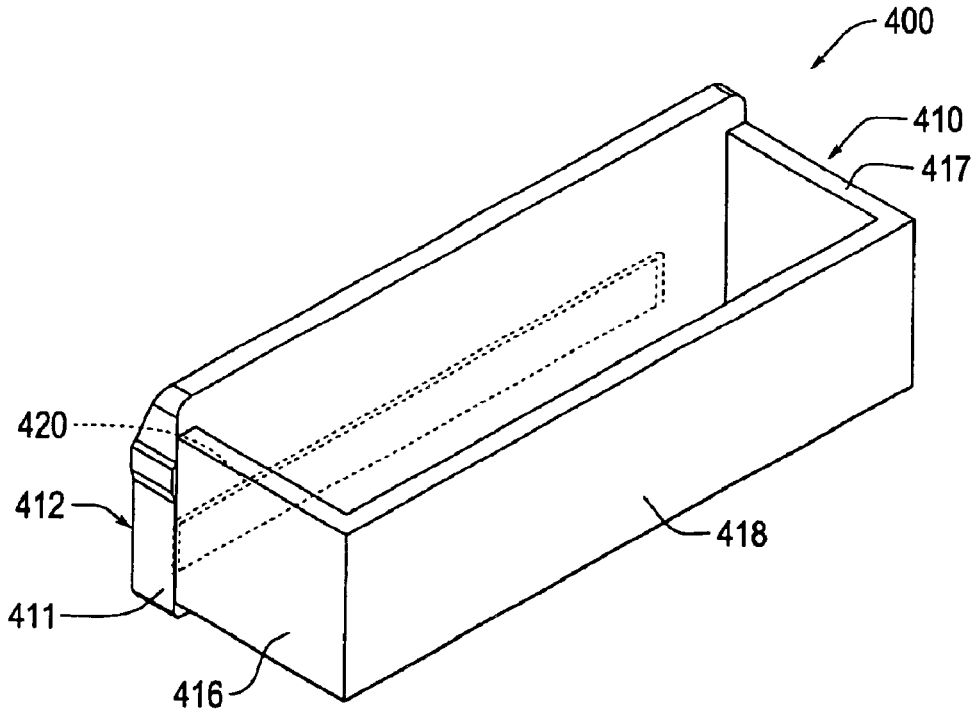
FIG. 5 is a block diagram illustrating a fourth exemplary embodiment of a heat sink formed using the systems and methods according to this invention.

FIG. 5 shows a fourth exemplary embodiment of a fluid ejector assembly 400 according to this invention. As shown in FIG. 5, the fluid ejector assembly 400 includes a heat sink 410 and a print element 420. The heat sink 410 includes a base 411 having two extending sidewalls 416 and 417 connected together by a connection wall 418.

In various exemplary embodiments, the fluid ejector element 420 is attached to the side surface 412 using an adhesive, or similar bonding mechanism. It should be appreciated that, in the various exemplary embodiments of the heat sinks 110, 210, 310 and/or 410, the orientation of filler materials used to tune the performance of the material used to form these heat sinks is oriented as outlined below with respect to FIGS. 5 and 6.

Figure 6:
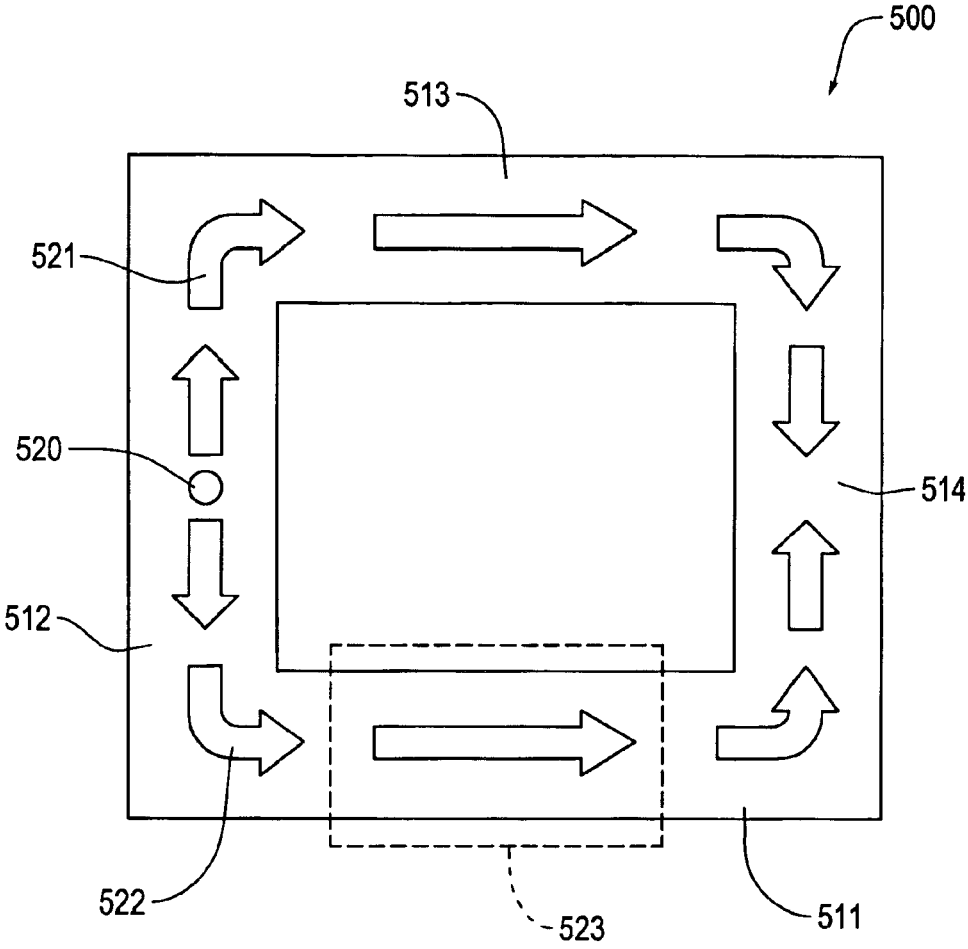
FIG. 6 is a schematic diagram illustrating a first exemplary embodiment of a technique for molding a heat sink usable according to this invention.

FIG. 6 is a schematic diagram illustrating a first exemplary embodiment of a technique for molding a heat sink usable according to this invention. As shown in FIG. 6, the one or more thermally conductive filler materials are oriented parallel to the die module. As a result, as shown in Table 1, coefficient of thermal expansion is obtained for the heat sink that is similar to that of the material used to make the die module. Thus, the bond between the substrate and the die module is not subjected to significant stress due to temperature changes. In addition, the oriented thermally conductive filler materials provide an effective heat sink for dissipating heat in the fluid ejector head.

As shown in FIG. 6, one exemplary embodiment of a heat sink molding apparatus 500 usable to form the heat sinks 110, 210, 310 and/or 410 includes sidewall channels 511, 512, 513 and 514. The highly conductive polymer used to form the heat sinks 110, 210, 310 and/or 410 is injected into the molding apparatus 500 through a gate 520 and flows in the flow directions 521 and 522 through the channels formed by the side walls 511, 512, 513 and 514. The flow directions 521 and 522 orient the filler material of the highly conductive polymer in an oriented flow area 523 so that the filler materials extend between a surface of the heat sink that receives heat from the fluid ejector head and one or more heat dissipations surfaces of the heat sink that dissipate the received heat into the environment around the fluid ejector head.

Figure 7:
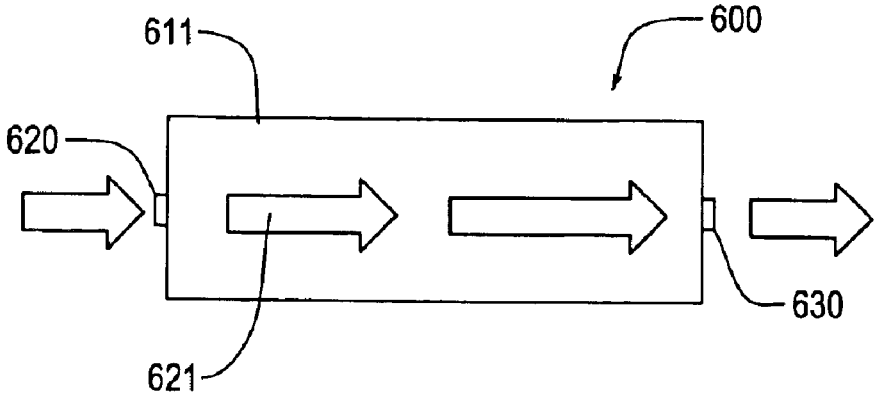
FIG. 7 is a schematic diagram illustrating a second exemplary embodiment of a technique for molding a heat sink usable according to this invention.

FIG. 7 is a schematic diagram illustrating a second exemplary embodiment of a technique for molding a heat sink usable according to this invention. As shown in FIG. 7, the one or more thermally conductive filler materials are oriented parallel to the die module. As a result, as shown in Table 1, coefficient of thermal expansion is obtained for the heat sink that is similar to that of the material used to make the die module. Thus, the bond between the substrate and the die module is not subjected to significant stress due to temperature changes. In addition, the oriented thermally conductive filler materials provide an effective heat sink for dissipating heat in the fluid ejector head.

As shown in FIG. 7, one exemplary embodiment of a heat sink molding apparatus 600 usable to form the heat sinks 110, 210, 310 and/or 410 includes sidewall channel 611. The highly conductive polymer used to form the heat sinks 110, 210, 310 and/or 410 is injected into the molding apparatus 600 through a gate 620 and flows in the flow direction 621 through the channel formed by the sidewall channel 611 and out an exit gate 630. The flow direction 621 orients the filler material of the highly conductive polymer so that the filler materials extend between a surface of the heat sink that receives heat from the fluid ejector head and one or more heat dissipations surfaces of the heat sink that dissipate the received heat into the environment around the fluid ejector head.

It should be appreciated that, in various exemplary embodiments of the orientation of the filler materials, various methods may be used to obtain a flow direction and are not limited to the exemplary embodiment as outlined with respect to FIGS. 5–7. For example, other exemplary embodiments of a heat sink molding apparatus can include a single elongate channel having a gate at one end.

Figure 8:
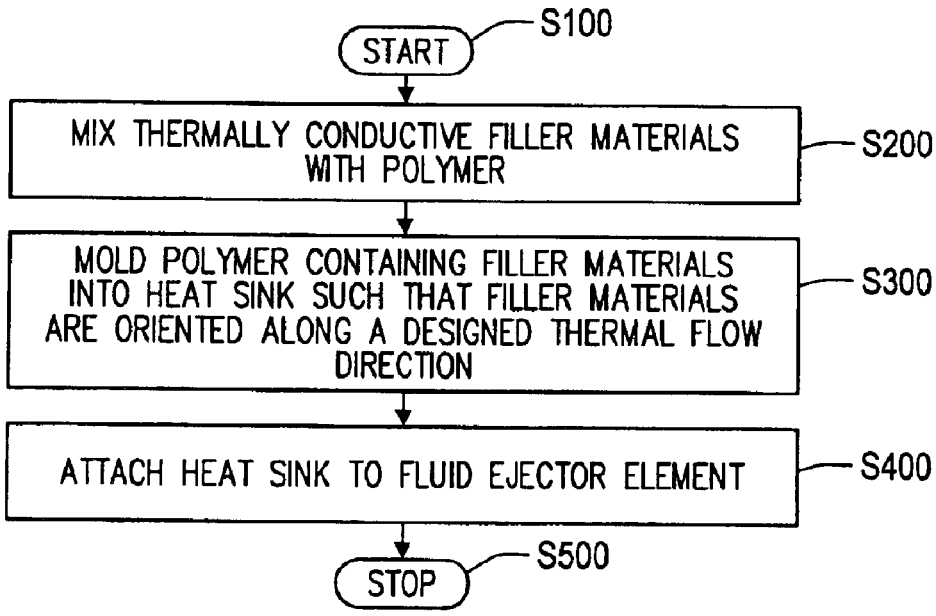
FIG. 8 is a flowchart outlining one exemplary embodiment of a method for manufacturing a print head having a heat sink according to this invention.

FIG. 8 is a flowchart outlining one exemplary embodiment of a method for manufacturing a fluid ejector assembly according to this invention. As shown in FIG. 8, operation of the method begins in step S100, and continues to step S200, where thermally conductive filler materials are mixed with a polymer. Then, in step S300, the polymer containing filler materials are molded into a heat sink such that filler materials are oriented along a designed thermal flow direction. Next, in step S400, the heat sink is attached to a fluid ejector element. Finally, operation continues to step S500, where operation of the method ends.

While this invention has been described in conjunction with various exemplary embodiments, it is to be understood that many alternatives, modifications and variations would be apparent to those skilled in the art. Accordingly, the preferred embodiments of this invention, as set forth above are intended to be illustrative, and not limiting. Various changes can be made without departing from the spirit and scope of this invention.

What is claimed is:

1. A fluid ejector assembly, comprising:

a heat sink attached to a container, the heat sink including a portion molded from a polymer having at least one thermally conductive filler material, the portion shaped to dissipate heat; and a fluid ejector module attached to the heat sink, wherein the polymer having at least one thermally conductive filler material has a thermal conductivity greater than about 10 W/m° C., the at least one thermally conductive filler material being fibrous, the at least one thermally conductive filler material is oriented substantially parallel to an oriented flow direction of heat from the fluid ejector module.

2. The fluid ejector assembly of claim 1, wherein the heat sink includes a plurality of fins extending out from the portion.

3. The fluid ejector assembly of claim 1, wherein materials used to form the heat sink and fluid ejector module have similar coefficients of thermal expansion.

4. The fluid ejector assembly of claim 1, wherein the polymer having at least one thermally conductive filler material has a thermal conductivity less than about 100 W/m° C.

5. The fluid ejector assembly of claim 1, wherein the at least one thermally conductive filler material is graphite.

6. The fluid ejector assembly of claim 5, wherein the graphite has been formed from a petroleum pitch base material.

7. The fluid ejector assembly of claim 1, wherein the at least one thermally conductive filler material is at least one ceramic material.

8. The fluid ejector assembly of claim 7, wherein the at least one ceramic material is at least one of boron nitride and aluminum nitride.

9. The fluid ejector assembly of claim 1, wherein the heat sink is chemically resistant to a fluid to be ejected by the fluid ejector module.

10. The fluid ejector assembly of claim 1, wherein the heat sink further includes a container that stores a fluid to be ejected by the fluid ejector module.

11. The fluid ejector assembly of claim 1, further comprising a container that stores a fluid to be ejected by the fluid ejector module.

12. A method of manufacturing a fluid ejector assembly, comprising:

molding a heat sink using a polymer material including at least one thermally conductive filler material, the at least one filler material being fibrous and having a thermal conductivity greater than about 10 W/m° C. and being oriented to be substantially parallel to an oriented flow direction of heat from the heat sink, the molded heat sink having a portion shaped to dissipate heat; and attaching the heat sink to at least one of a fluid ejector module and a container to form the fluid ejector assembly.

13. The method of claim 12, further comprising forming a plurality of fins extending out from the portion.

14. The method of claim 12, further comprising, prior to molding the heat sink, mixing at least one filler material having a thermal conductivity greater than about 10 W/m° C. with the polymer.

15. The method of claim 12, further comprising, prior to molding the heat sink, mixing at least one filler material having a thermal conductivity less than about 100 W/m° C. with the polymer.

16. The method of claim 12, wherein:

molding the heat sink comprises molding the heat sink integrally with the container; and attaching the heat sink comprises attaching the heat sink and the integral container to the fluid ejector module to form the fluid ejector assembly.

17. The method of claim 12, wherein attaching the heat sink comprises attaching the heat sink to the fluid ejector module and the container to form the fluid ejector assembly.

* * * * *